US005195885A

United States Patent [19]

Medina

[11] Patent Number: 5,195,885

[45] Date of Patent: Mar. 23, 1993

[54] SELF-PROVING BURNER IGNITER WITH STABLE PILOT FLAME

[75] Inventor: Ramon A. Medina, Houston, Tex.

[73] Assignee: Forney International, Inc., Addison, Tex.

[21] Appl. No.: 650,205

[22] Filed: Feb. 4, 1991

[51] Int. Cl.[5] ..... F23Q 9/00

[52] U.S. Cl. ..... 431/25; 431/265; 431/78; 431/353

[58] Field of Search ..... 431/25, 75, 78, 264, 431/265, 266, 263, 350, 349, 353, 181, 182, 185, 186, 187, 173; 239/403; 60/39.826, 39.827, 39.828

[56] References Cited

U.S. PATENT DOCUMENTS

| | | | |
|---|---|---|---|
| 1,122,740 | 12/1914 | Gwynn . | |
| 1,535,240 | 4/1925 | Morris | 60/39.827 X |
| 2,113,846 | 4/1938 | Van Law | 431/187 X |
| 2,645,278 | 7/1953 | Holthouse, Sr. et al. | 431/265 X |
| 2,860,695 | 11/1958 | Lake | 431/349 R |
| 3,145,764 | 8/1964 | Rackley | 431/265 X |
| 3,463,602 | 8/1969 | Bitterlich et al. | 431/188 |
| 4,391,582 | 7/1983 | Cowan . | |
| 4,431,400 | 2/1984 | Kobayashi . | |
| 4,518,348 | 5/1985 | Wedge . | |
| 4,595,355 | 6/1986 | Garrelfs et al. | 431/265 |
| 4,971,552 | 11/1990 | Fukuda et al. | 431/9 X |
| 4,978,293 | 12/1990 | Ryno | 431/265 X |

FOREIGN PATENT DOCUMENTS

| | | | |
|---|---|---|---|
| 1076710 | 2/1984 | U.S.S.R. | 431/264 |
| 1732550 | 11/1968 | United Kingdom | 431/349 |
| 1565247 | 4/1980 | United Kingdom | 431/353 |

*Primary Examiner*—Carl D. Price
*Attorney, Agent, or Firm*—Lane, Aitken & McCann

[57] ABSTRACT

In a pilot light igniter for a burner, an inner tube for receiving fuel gas is concentrically positioned within an outer tube for receiving air in the annular space between the inner tube and the outer tube. Apertures are formed in the inner tube to impart angular momentum to the fuel gas as it flows from the inner tube into the annular space so that the mixture of air and gas swirls as it flows to the open distal end of the outer tube. A spark disk is provided on the end of the inner tube and a flame rod extends axially from the spark disk. The air and fuel mixture is ignited by a spark produced by high voltage applied between the spark disk and the outer tube. A low voltage source applied between the flame rod and the outer tube causing current pulses provides an indication of the presence of a flame.

8 Claims, 2 Drawing Sheets

16
13
11
17
AIR
FUEL GAS
19

PUSH BUTTON
41
ONE SHOT
43
SPARK TIMER
45
START CYCLE TIMER
47
49
51
53
LOW VOLTAGE SOURCE
55
POWER CIRCUIT
39
37
35
57
AMP
59
PEAK DETECTOR CIRCUIT
61
VOLTAGE COMPAR-ATOR
63
65
SL
SL
67
BURNER FUEL SHUT OFF CONTROL

SELF-PROVING BURNER IGNITER WITH STABLE PILOT FLAME

BACKGROUND OF THE INVENTION

This invention relates to a burner igniter, and, more particularly, to a burner igniter of the gas pilot type, which itself is ignited by an electric spark.

In gas pilot light igniters for burners, it is important to have flame stability so that the pilot light flame will remain lit and also to project the flame of the igniter a substantial distance so that the igniter hardware can be positioned at a relatively remote position from the burner to reduce the heat from the burner applied to the igniter hardware and thereby prolong the life of the burner. In addition, it is important to be able to ignite the flame in the igniter and to reliably detect that the igniter is lit. The igniter of the present invention satisfactorily meets the above-described needs at a relatively low cost.

SUMMARY OF THE INVENTION

In accordance with the invention, the pilot light igniter comprises inner and outer tubes arranged concentrically. The distal end of the inner tube, which carries the fuel gas to the igniter, is closed by a high voltage insulating isolation ceramic spacer. Mounted on the spacer is an electrically conducting spark disk having the same diameter as the inner tube and the ceramic spacer. An electrically conducting flame rod connected to the spark disk extends axially from the spark disk and terminates within the outer tube. The inner tube adjacent to the ceramic spacer is provided with apertures spaced around the inner tube and angled relative to radial so that the fuel gas flowing through the inner tube will exit from the inner tube into the space between the inner tube and the outer tube where it will be mixed with air carried by the outer tube. The angled direction of the apertures will give angular momentum to the fuel gas mixture flowing through the annular mixing space and the mixed air and gas flows in a spinning or helical motion as it moves downstream over the ceramic spacer, spark disk and flame rod and out through the open distal end of the outer tube. When the air gas mixture has been lit, the velocity of the spinning gases in the combustion zone will be maintained in equilibrium with the resulting flame propagation velocity which gives the flame stability so that the root of the flame is stationary within a four inch combustion chamber surrounding the flame rod. In addition, a stable tail of the flame will extend from the tube for a length of about 12 inches so that the burner may be lit from a relatively remote position. As a result, the amount of heat applied to the igniter hardware from the burner flame is reduced. The root of the flame within the combustion chamber around the flame tube is an ion rich zone which makes it possible to detect the presence of a flame by applying a low voltage between the flame rod and the outer tube and then detecting and integrating the amplitude of the current flow between the flame rod and the outer tube. To ignite the flame, a high voltage is applied between the spark disk and the outer tube to generate a spark across the annular space between the spark disk and the outer tube through which the spinning mixture of air and fuel gas flows.

DESCRIPTION OF A PREFERRED EMBODIMENT

Figures 1, 5:
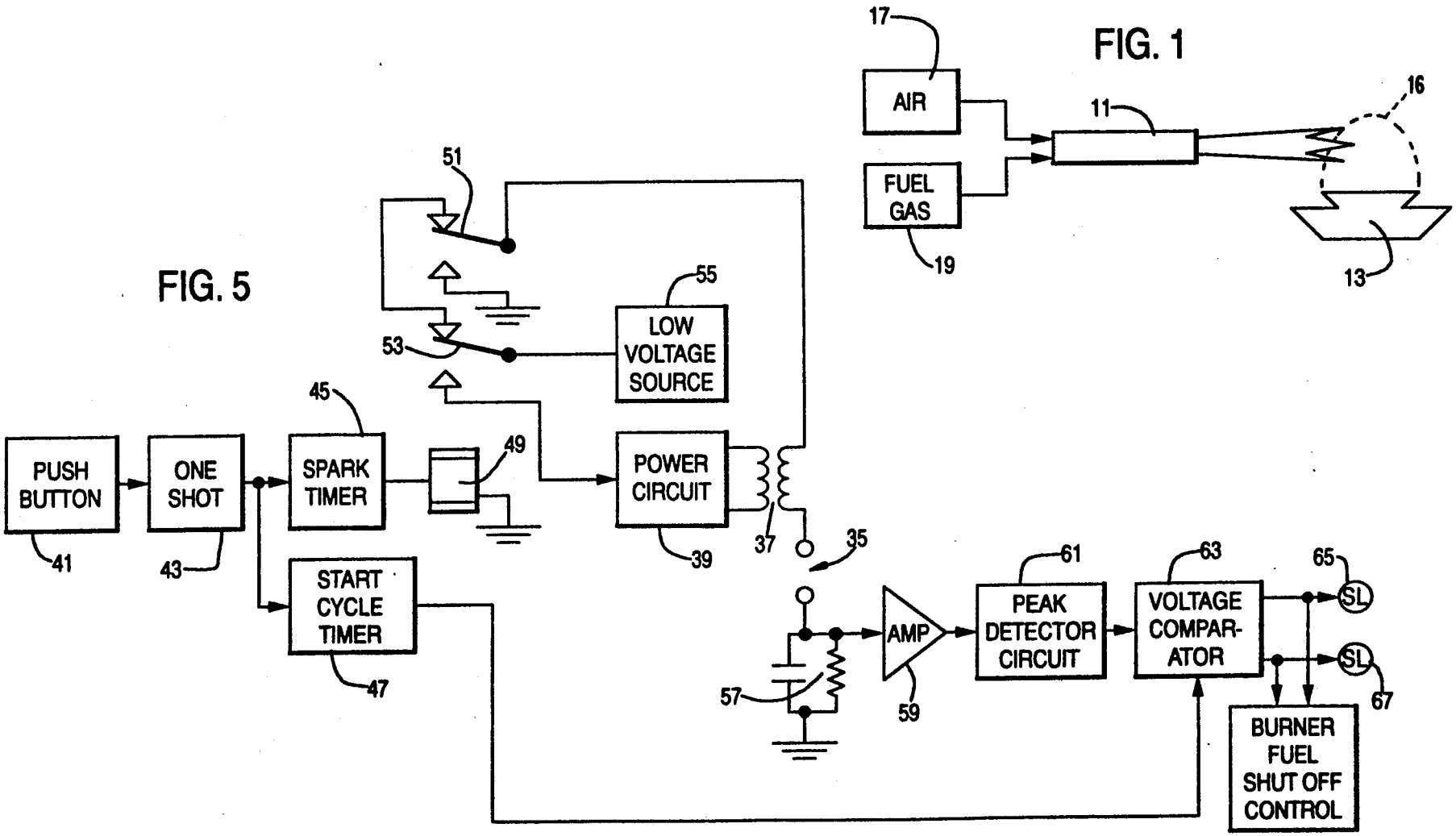
FIG. 1 is a schematic illustration showing the igniter of the present invention with a burner to be lit by the igniter.
FIG. 5 is a block diagram of the circuit for igniting the gas fuel mixture in the igniter and for detecting the presence of a flame in the igniter.

In the schematic illustration showing the application of the pilot light igniter of the present invention, the igniter 11 is positioned remotely ten to twelve inches from the combustion zone over a gas or oil burner 13 so that when the igniter 11 is lit, the flame 15 from the igniter will project into the combustion zone 16 over the burner 13 to ignite the fuel issuing from the burner 13. The igniter 11 is supplied with air under low pressure from a source 17, the pressure being sufficient to cause air flow at the desired rate through the igniter 11. The igniter is also supplied with fuel gas under pressure from a fuel gas source 19 with the pressure of the fuel gas being selected to provide a desired flow rate for the fuel gas through the igniter.

Figure 2:
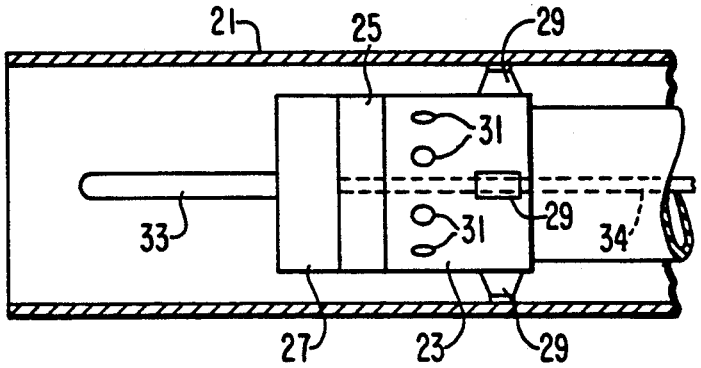
FIG. 2 is a view in partial axial section of the igniter of the invention.
Figure 3:
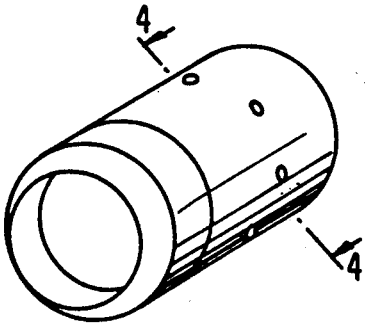
FIG. 3 is a perspective view of the inner tube of the igniter.
Figure 4:
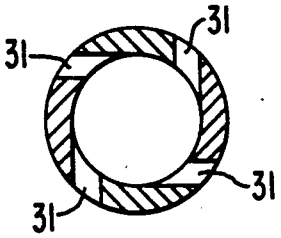
FIG. 4 is a cross sectional view through the inner tube of the igniter taken along the line 4—4 of FIG. 3.

As shown in FIG. 2, the igniter of the present invention comprises an electrically conducting outer tube 21 concentric with an inner tube 23 to define an annular space between the outer tube and the inner tube. The distal end of the inner tube 23 is closed by a ceramic spacer disk 25. Mounted on the spacer disk 25 is an electrically conducting spark disk 27 having the same diameter as the tube 23 and the spacer disk 25. The distal end of the tube 23 is spaced inwardly from the open distal end of the tube 21 so that the outer axial end of the spark disk 25 is four inches from the end of the tube 21 to provide a four inch combustion chamber. The inner tube 23 is centered in the tube 21 by means of four insulating spacers 29. Apertures 31 communicate the interior of the tube 23 with the annular space between the tube 23 and the tube 21. The apertures 31 are positioned immediately downstream from the spacers 29. An electrically conducting flame rod 33 extends axially from the spark disk 27 and is electrically connected to the spark disk 27. Air is supplied to the annular spaced between the tubes 21 and 23 from the source 17 and fuel gas is supplied from the source 19 to the tube 23. The fuel gas will flow from the tube 23 through the apertures 31 into the annular space between the tubes 23 and 21 and mix with the air and the mixed air and fuel will flow through the annular space between the tube 21 and the spark disk 27 and then through the combustion chamber surrounding the flame rod 33 to the open end of the tube 21. As shown in FIG. 3, the apertures 31 are cylindrical and have axes angled at 45 degrees relative to the radii of the tube 23. As a result, the gas, upon exiting from the tube 23 into the annular space between the tube 23 and the tube 21, will have an angular momentum and the mixture of the gas and air will swirl as it moves downstream from the apertures 31 to the open end of the tube 21. When a high voltage is applied between the spark disk 27 and the tube 21, a spark will be generated across the annular gap between the disk 27 and the tube 21 which spark will ignite the air fuel mixture flowing through this annular space. The high voltage is applied to the spark disk 27 by means of an electrically conducting rod 34 extending along the axis of the tube 23 and passing through the ceramic spacer 25. The swirling motion imparted to the gas and fuel air mixture will cause a stable flame to be generated with the root of the flame in the four inch combustion zone of the igniter surrounding the flame rod 33 and with a stable flame tail extending twelve inches from the open end of the tube 21. Because the structure provides the stable 12 inch tail to the flame, the open end of the igniter tube 21 can be remotely located 10–12 inches from the burner 13 and, thus, avoid applying excessive heat to the igniter 11.

In the block diagram of FIG. 5, the spark gap between the spark disk 27 and the tube 21 is represented at 35. When power is applied to the primary winding of a high voltage transformer 37 by power circuit 39, the secondary winding of the transformer 37 will apply a high voltage across the spark gap 35 and generate a spark across the spark gap. To generate the spark, a push button 41 is actuated to trigger a one-shot multivibrator 43, which applies a pulse to initiate a spark timer 45 and a start cycle transition timer 47. The spark timer will energize a relay 49 for two seconds to move its contacts 51 and 53 from their upper position, as shown, to their lower position. In the lower position, the contact 51 connects ground to one side of the secondary of the transformer 37. In the lower position, the contact 53 connects a low voltage source 55 to the power circuit 39 and causes the power circuit 39 to apply AC power to the primary of the transformer 37. As a result, the secondary winding of the transformer 37 will apply high voltage across the spark gap 35 connected in series with a parallel circuit 57 comprising a resistor and capacitor. The high voltage generated by the secondary winding of the transformer 37 will be applied across the gap 35 and the parallel circuit 51 as a voltage divider and generate a spark across the spark gap 35 for the two-second period that the spark timer 45 energizes the relay 49. At the end of the two-second period, the relay 49 is de-energized and the contacts 51 and 53 return to their upper position. This action removes the power from the primary of the transformer 37 and also connects the voltage source 55 through the contacts 51 and 53 to the opposite side of the secondary winding 37 from the gap 35. As a result, the low voltage from the low voltage source 35 will be applied across the series circuit of the gap 35 and the parallel circuit 57. Because the flame rod 33 is electrically connected to the spark disk 35, the low voltage will be applied between the flame rod 33 and the tube 21. As a result, when the fuel air mixture has been ignited by the spark across the spark gap between the disk 27 and the tube 21 and a stable flame root exists in the combustion chamber around the flame rod 33, the high degree of ionization in the flame root together with the low voltage applied between the flame rod 33 and the outer tube 21 will cause current pulses to flow between the flame rod 33 and the tube 21 and through the parallel circuit 57. This action will cause voltage pulses to be generated across the parallel circuit 57. The voltage pulses will be amplified by an amplifier 59 and then applied to a peak detector circuit 61 which charges a capacitor to a signal voltage corresponding to the amplitude of an applied pulse and then allows the signal voltage to decay. The signal voltage thus depends on the amplitude of and time interval between pulses. A voltage comparator 63 detects whether signal voltage on the capacitor of the peak detector circuit 61 is between a minimum value and a maximum value indicative of the presence of a flame in the combustion chamber. The maximum value is set a little above the peak voltage to which the capacitor of the peak detector circuit 61 is charged by an applied pulse derived from a current pulse flowing through the ionization of a flame route in response to the applied low voltage from low voltage source 55. The minimum value and the decay rate of the signal voltage on the capacitor of the peak detector circuit 61 are selected so that the signal voltage on the capacitor of the peak detector 61 will decay below the minimum if the voltage is not refreshed by an applied pulse within about 1.5 seconds. If the output signal voltage 61 is below the maximum, it will energize the signal lamp 65. If the signal voltage is above the minimum, it will energize the signal lamp 57. If both lamps are lit, it means that the flame is present. If the lamp 65 is not lit, meaning that the voltage is above the maximum, this means that there is a short across the ignition tube. If the signal lamp 67 is not lit, meaning that the voltage is below the minimum, this means that a flame is not present in the combustion chamber or that the flame rod or the inner surface of the igniter tube has become coated and will not permit the low voltage current pulses to flow.

The output signals from the voltage comparator 63 applied to the signal lamps 65 and 67 are also applied to a burner fuel shutoff control 69 which will shut off fuel flow to the burner 13 shown in FIG. 1 and to the igniter if both signals are not present indicating that the signal voltage is between the minimum and the maximum.

The start cycle transition timer 47 in response to receiving the signal pulse from the one-shot 43 applies a signal to the voltage comparator 63 for slightly longer than a 2 second interval that the spark timer 45 energizes the relay 49. The signal voltage from the start cycle transition timer 47 will override the signal applied to the voltage comparator 63 from the integrator 61 so that the voltage comparator 63 will produce signals on both outputs to energize the signal lamps 65 and 67 and to signal the presence of a flame to the burner fuel shutoff control 69 for the duration of the applied signal from the start cycle transition timer. In this manner, the voltage comparator signals the presence of a flame during the time that the signal is being generated across the spark gap.

As pointed out above, the swirling motion imparted to the air fuel mixture in the igniter combustion chamber gives stability to both the root of the flame and the tail of the flame and allows a stable flame to be projected a substantial distance from the outer tube of the igniter. This enables the igniter to be positioned remotely from the burner 13 while still providing reliable ignition of the burner 13 and avoids excessive heat from being applied to the igniter hardware. Reliable ignition is applied to the swirling air and gas fuel mixture across the annular spark gap between the spark disk and the outer tube. The stable flame root provided in the combustion chamber around the flame rod enables the presence of the flame to be reliably detected by the low voltage applied between the flame rod and the outer tube resulting in the current pulses flowing across the spark gap.

The above description is of a preferred embodiment of the present invention and modification may be made thereto without departing from the spirit and scope of the invention which is defined in the appended claims.

I claim:

1. An igniter comprising an inner tube for receiving the fuel gas and having a closed distal end, an outer tube for receiving air concentric with said inner tube and having an open distal end, said inner tube having apertures communicating said inner tube with an annular space between said inner tube and said outer tube, said apertures being angled relative to the radii from the axis of said inner tube to impart angular momentum to the fuel gas flowing from said inner tube into the annular space between said inner tube and said outer tube so that a mixture of air and fuel gas will swirl as it flows from said apertures toward the open distal end of said outer tube, an electrically conducting spark disk on the distal end of said inner tube defining an annular gap between said spark disk and said outer tube, the air and fuel mixture moving in a swirling motion from said apertures in said inner tube through said annular gap between said spark disk and said outer tube, and means to generate an electrical spark across said annular gap between said spark disk and said outer tube to ignite the air and fuel mixture moving through said annular gap.

2. A burner igniter combination as recited in claim 1, wherein an insulating disk is provided between said spark disk and said inner tube.

3. An igniter as recited in claim 1, further comprising an electrical conducting flame rod electrically connected to said spark disk and projecting axially from said spark disk toward the open distal end of said outer tube, the air and fuel mixture swirling around said flame rod as said mixture flows toward the open distal end of said outer tube, means to apply a low voltage between said flame rod and said outer tube after termination of the spark across said annular gap to cause current pulses to flow between said flame rod and said outer tube, and means responsive to the presence of said current pulses to indicate the presence of a flame in the space between said flame rod and said outer tube.

4. A burner igniter combination as recited in claim 3, wherein said means responsive to said current pulses comprises means to provide a signal depending upon the amplitude of and time interval between said current pulses and means to determine whether said signal is between a maximum and a minimum.

5. A burner igniter combination comprising a burner having a combustion zone, an igniter positioned remotely from said burner to project a flame into the combustion zone of said burner, said igniter comprising an inner tube for receiving fuel gas and having a closed distal end, an outer tube for receiving air concentric with said inner tube and having an open distal end, said inner tube having apertures communicating said inner tube with an annular space between said inner tube and said outer tube, said apertures being angled relative to radii from the axis of said inner tube to impart angular momentum to the fuel gas flowing from the inner tube into the annular space between said inner tube and said outer tube so that a mixture of an air and fuel gas will swirl as it flows from said apertures toward the open distal end of said outer tube, whereby said igniter will project a stable flame tail from the open end of said outer tube to the combustion zone of said burner, an electrically conducting spark disk on the distal end of said inner tube defining an annular gap between said spark disk and said outer tube, the air and fuel mixture moving in a swirling motion from said apertures in said inner tube through the annular space between said spark disk and said outer tube, and means to generate an electrical spark across said annular gap between said spark disk and said outer tube.

6. A burner igniter combination as recited in claim 5, wherein an insulating disk is provided between said spark disk and said inner tube.

7. A burner igniter combination as recited in claim 5, further comprising an electrically conducting flame rod electrically connected to said spark disk and projecting axially from said spark disk toward the open distal end of said outer tube, the air and fuel mixture swirling around said flame rod as said mixture flows toward the open distal end of said outer tube, means to apply a low voltage between said flame rod and said outer tube after termination of the high voltage applied across said spark gap to cause current pulses to flow between said flame rod and said outer tube, and means responsive to the presence of said current pulses to indicate the presence of a flame in the space between said flame rod and said outer tube.

8. A burner igniter combination as recited in claim 7, wherein said means responsive to said current pulses comprises means to provide a signal depending upon the amplitude of and time interval between said current pulses and means to determine whether said signal is between a maximum and a minimum.

* * * * *